US005299753A

United States Patent [19]

Alexander, III

[11] Patent Number: 5,299,753

[45] Date of Patent: Apr. 5, 1994

[54] CLOTH TAKEUP AND METHOD

[75] Inventor: William J. Alexander, III, Mauldin, S.C.

[73] Assignee: Alexander Machinery, Inc., Mauldin, S.C.

[21] Appl. No.: 952,309

[22] Filed: Sep. 28, 1992

[51] Int. Cl.[5] ..... B65H 18/10; B65H 23/14

[52] U.S. Cl. ..... 242/75.2; 242/67.1 R; 242/75.5

[58] Field of Search ..... 242/75.2, 75.5, 75.51, 242/75.52, 75.53, 67.1 R, 75.1, 65, 66

[56] References Cited

U.S. PATENT DOCUMENTS

| | | | |
|---|---|---|---|
| 3,198,453 | 8/1965 | Aaron | 242/65 |
| 3,348,787 | 10/1967 | Giles | 242/75.5 |
| 3,650,490 | 3/1972 | Saunders | 242/75.5 X |
| 3,687,389 | 8/1972 | Adams | 242/75.51 X |
| 3,730,450 | 5/1973 | Hank | 242/75.51 X |
| 3,853,282 | 12/1974 | Wentworth | 242/75.2 X |
| 3,858,820 | 1/1975 | Crouse | 242/66 |
| 3,871,598 | 3/1975 | Kataoka | 242/65 X |
| 4,025,009 | 5/1977 | Fineo | 242/75.5 |
| 4,139,166 | 2/1979 | Powell et al. | 242/66 |
| 4,150,797 | 4/1979 | Kataoka | 242/67.1 R |
| 4,216,804 | 8/1980 | Alexander | 242/45 |
| 4,552,317 | 11/1985 | Halter | 242/75.2 X |
| 4,634,069 | 1/1987 | Kataoka | 242/75.51 X |
| 5,056,730 | 10/1991 | Buckle | 242/75.2 |

*Primary Examiner*—John M. Jillions
*Attorney, Agent, or Firm*—Ralph Bailey

[57] ABSTRACT

A loom cloth takeup having pivotally mounted arms A exerting a force upon a friction roll (F) has first and second control devices (E) and (H) respectively for controlling tension on the cloth ahead of the friction roll (F) and for controlling a motor (G) driving the friction roll (F) to afford full roll tension control during the build of the cloth roll.

10 Claims, 2 Drawing Sheets

CLOTH TAKEUP AND METHOD

BACKGROUND OF THE INVENTION

This invention relates to control means for maintaining suitable tension in a center wound cloth roll takeup and the like. The tension applied to the cloth or other web by a friction roll is controlled so as to make possible the production of a tightly wound cloth roll during its full build. Such control, for example, may be especially useful for winding cloth manufactured from fiberglass or carbon yarn and the like.

Heretofore, compensator rolls for controlling tension in a surface wound cloth takeup have been disclosed in U.S. Pat. No. 4,216,804. Cloth takeups having hold down arms and the like for applying tension to cloth by driven friction rolls as it is wound on a center wound roll are illustrated in U.S. Pat. No. 4,139,166. The following U.S. Pat. Nos. are further illustrative of the state of the art: 4,025,009; 3,858,820; 3,730,450; and 3,687,388. In the winding of tight cloth rolls for certain fabrics, it has been found that center wound rolls are preferable to surface wound takeup rolls. It is also desirable to control and thereby limit the tension exerted upon the fabric from the friction roll, as the cloth is being wound upon the center wound cloth roll, back to the loom. Otherwise, the weaving process may be disrupted due to the application of heavy tension tending to pull the warp yarns and the cloth out of the loom. Hold down rolls such as illustrated in U.S. Pat. No. 4,139,166 have been provided on hold down arms held with a force as exerted by a cylinder provided with adjustable braking means to control tension in the cloth at the point of winding. However, it has not been possible to constantly and uniformly adjust the brake so as to constantly vary the tension exerted upon the cloth by the friction or rubber covered roll during the entire build of the cloth roll. Furthermore, since it is necessary to raise the hold down arm to remove the cloth during a doffing operation, control means which may be actuated by movement of the hold down arm during the build of the cloth roll have been limited in their controlling function during at least a portion of the build.

Accordingly, it is an important object of this invention to provide a cloth takeup having a friction roll applying tension to the cloth at the point of winding the cloth upon the takeup roll and for controlling tension from the friction roll back to the loom. By controlling the tension exerted by the friction roll during the build a uniform tight cloth roll is produced.

Another important object of the invention is to provide a cloth takeup producing a tight roll especially suitable for fiberglass fabric and fabrics constructed of carbon yarn and the like so as to avoid wrinkles and variations in tension upon the cloth throughout the build of the roll.

Still another important object of the invention is the provision of a hold down device for winding cloth affording full roll tension control during the entire build of the cloth roll.

Another important object of the invention is the provision of a center wound cloth roll takeup utilizing a hold down roll exerting constant tension where the cloth is being wound and a compensator roll for controlling tension back to the loom.

SUMMARY OF THE INVENTION

It has been found that a center wound cloth roll takeup having a constant force exerted through a hold down arm and the like may be provided with a compensator roll for controlling the output of a motor driving the center wound cloth roll so as to control the tension on the cloth from the hold down mechanism back to the loom. A tight roll may be wound since a motor driven friction roll may be provided having a second tension control, independent of the motor driving the takeup roll, which exerts full roll tension control during the build by a second control actuated by a hold down arm as it engages the periphery of the cloth roll during the building operation. The hold down arm moves a pivoted lever downwardly during the build so as to permit the hold down arm to be raised beyond its operating stroke upon completion of the build for doffing the cloth roll without interference with the controls for the hold down arm during the building motion.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a loom cloth takeup having a center wound roll receiving cloth from a loom and building a cloth roll. A pivotally mounted arm A carries a friction roll F engaging the cloth as it is wound on the center wound cloth roll. An extensible power operated means B exerts a constant force against the arm A urging the friction roll into proper position to exert tension upon the cloth. A first motor C exerts a force driving the center wound roll. A compensator roll D is supported by the cloth passing thereover moved responsive to variations in tension in the cloth occurring between the loom and the friction roll. A first control device E actuated in response to movement of the compensator roll varies the output of the motor C and the resulting tension on the cloth. The friction roll F carried by the arms A is driven by the motor G applying tension to the cloth as it is wound on the cloth roll. A second control device H is actuated in response to outward pivotal movement of the arms A during building of the cloth roll varying the tension applied by the friction roll to the cloth.

Figures 1, 2:
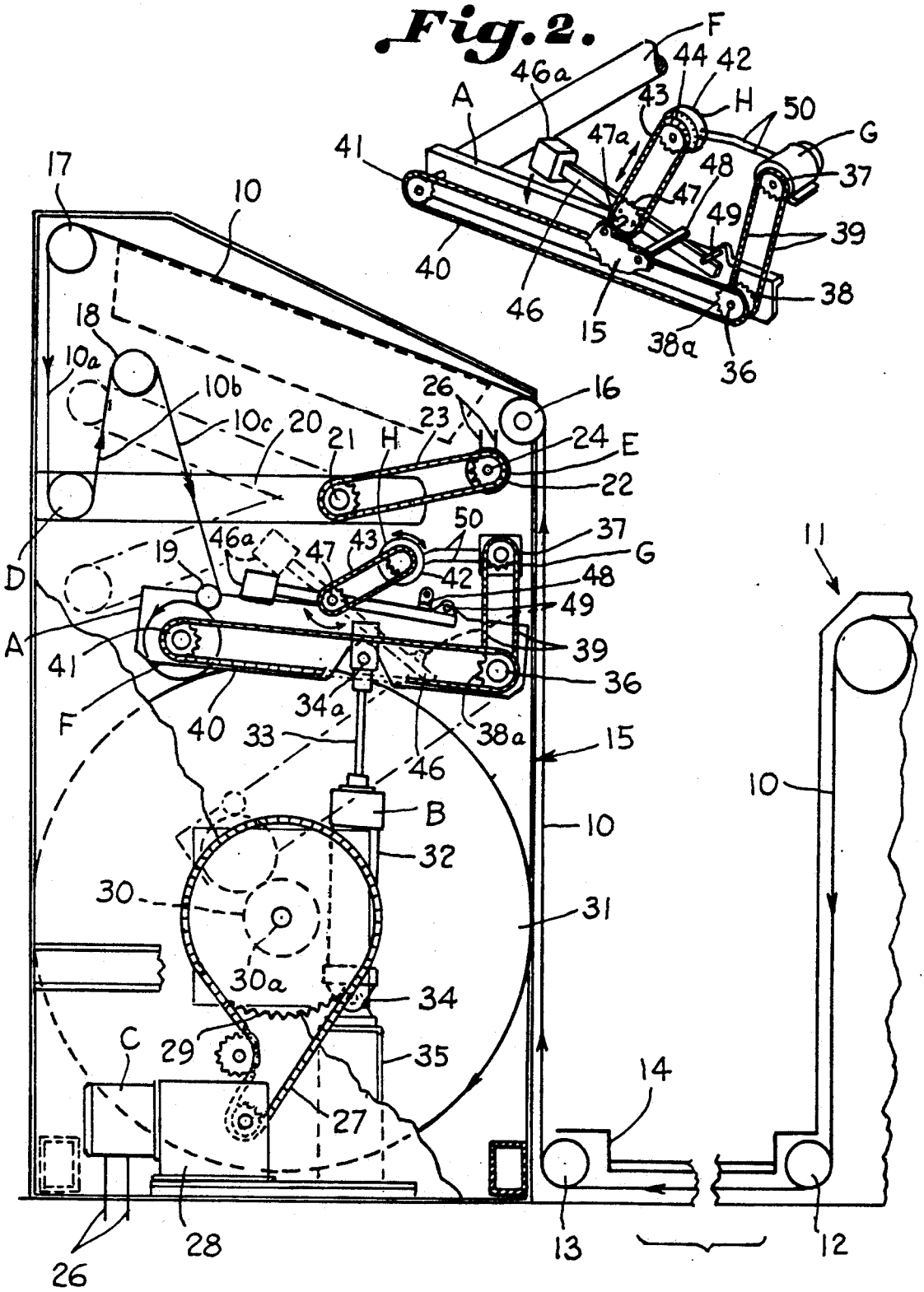
FIG. 1 is a side elevation illustrating a center wind takeup having first and second control devices for respectively controlling tension between a friction roll and the loom, and tension exerted by the friction roll upon the cloth during the build constructed in accordance with the present invention.
FIG. 2 is a perspective view illustrating a control mechanism for varying the drive of the friction roll during the build with means for disengaging same during doffing of the cloth roll.
Figure 3:
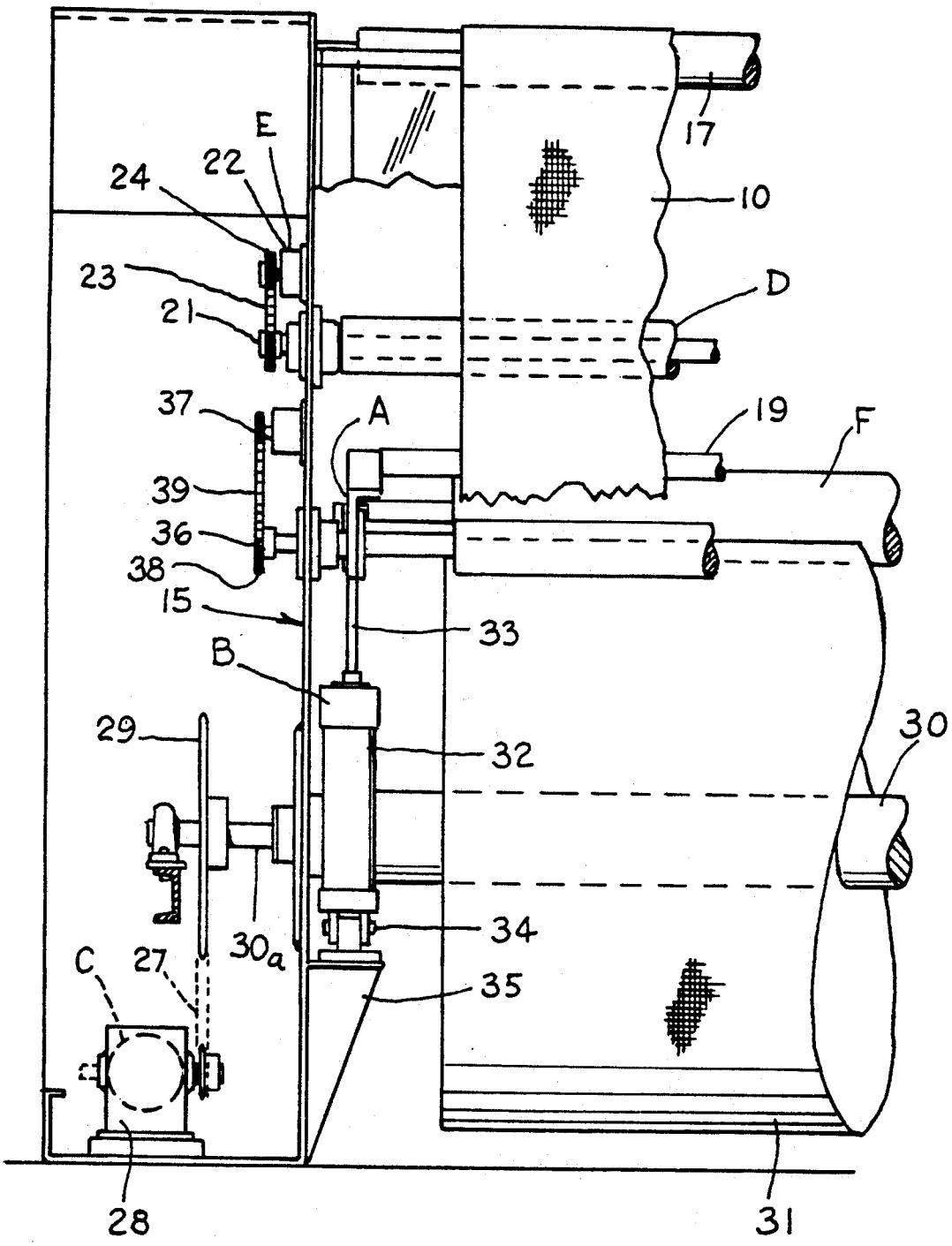
FIG. 3 is a front elevation illustrating drive mechanism for the cloth roll which is controlled to establish a desired limited tension between a friction roll and the loom in response to a compensator roll, together with the positioning of the friction roll controlling the tension exerted upon the cloth at the point of winding upon the roll during the build of the cloth roll.

Referring more particularly to FIG. 1, the cloth 10 is illustrated as being woven upon a loom broadly designated at 11. The cloth 10 passes downwardly over direction rolls 12 and 13 to be carried beneath the weaver's platform 14. The cloth takeup is illustrated as having a frame member broadly designated at 15 which carries the rolls and the various components described herein. The cloth 10 is illustrated as passing upwardly across the rear of the frame over a direction roll 16 and thence forwardly over a suitable direction roll 17 prior to a downward run 10*a* of the cloth 10 prior to passing over the movable compensator or other tension control roll D from which the cloth passes in an upwardly run 10*b* and over a direction roll 18 and thence downwardly over a roll 19 in a downwardly run 10*c* to a movable friction roll F which is carried by the hold down arm A.

The compensator roll D is illustrated as being carried by a pivoted arm 20, but it may take the form of a dancer roll carried for vertical movement. The compensator roll may be of the type further illustrated in U.S. Pat. No. 4,216,804. The pivoted arm 20 is secured for pivotal motion at 21 upon the frame 15.

The first control device E includes a potentiometer 22 which is actuated by any suitable drive means such as the chain 23 which passes over a sprocket 24 turned responsive to the oscillations of the arm 20 for controlling the output of the potentiometer.

The output from the potentiometer drives the motor C as through suitable leads 26. The motor drives a chain 27 through a suitable gear box 28 for driving a sprocket 29 for controlling the winding action of the core 30 carried by the shaft 30*a* which carries the web takeup roll 31.

It will be observed that the hold down arm A exerts a constant force against the cloth 10 through the extensible device B which may be provided in the form of a fluid, preferably air, operated cylinder 32 having a piston rod 33 or a linear force actuator or the like and may be utilized to exert the force applying pressure through the friction roll F against the cloth adjacent the point of winding. The cylinder 32 is carried by a pivotal mounting 34 carried upon a stand 35. The force applied by the cylinder may actually be in most instances an upward force to maintain the friction roll F slightly above and adjacent the cloth roll so that the force exerted thereby is preferably a simple friction hold back or braking action. However, the arms A will be referred to, as usual, as hold down arms although they may provide an upward force on the friction hold down roll F.

The hold down arms A are illustrated as being pivotally mounted at 36 upon the frame 15. A second motor G drives the friction roll F through a suitable drive mechanism which is illustrated as including sprockets 37 and 38 and a chain 39. The sprocket 38*a* through a chain 40 drives a sprocket 41 for controlling and varying the speed and hence the tension applied by the friction roll F to the cloth 10 as it is wound upon the center wound takeup roll 31. The tension applied to the cloth is also dependent upon the coefficient of friction of the surface of the friction roll. The friction roll is driven by the cloth in a direction opposite to the direction of rotation of the cloth roll. The motor drives the friction roll in a direction opposite to the driving force exerted by the cloth so that the friction roll exerts a braking action tensioning the cloth as it is wound.

A second control device H includes a potentiometer 42 actuated by a chain 43 the ends of which are suitably positioned upon sprockets 44 and 47. The sprocket 47 best shown in FIG. 2 is rotated by a link 46 which is pivoted centrally of the sprocket 47 on the stub shaft 47A (FIG. 2). One end of the link 46 is biased upwardly toward a stop member 48 carried by the frame 15 and is depressed by a control member 49 carried by the arms A during movement as a result of the build of the cloth roll. The link 46, which acts as a control arm, has a weight 46*a* biasing the other end of the link downwardly. The potentiometer 42 of the control device H controls the second motor G through the leads 50.

It is thus seen that a cloth takeup has been provided which is especially suitable for building tight cloth rolls. The tension on the cloth or other web is controlled ahead of the friction roll F between it and the loom 11 through a suitable compensator roll and the like while full roll tension control is exerted during the build by a constantly varying drive device exerted upon the friction roll. The hold down or friction roll is positioned under the control of the hold down arms positioned by the power operated means B during the building operation so as to float against the cloth being wound on the cloth roll. Since the adjacent hold down arm prevents upward movement of the end of the link 46 remote from the weight during the build and prior to engagement by the stop 48, the hold down arm may be freely pivoted upwardly for doffing of the cloth roll after engagement of the link with the stop 48 without interfering with the control exerted by the link upon the second motor G.

While a preferred embodiment of the invention has been described using specific terms, such description is for illustrative purposes only, and it is to be understood that changes and variations may be made without departing from the spirit or scope of the following claims.

What is claimed is:

1. A tension control for a cloth takeup having a center wound core roll building a cloth roll thereon comprising:

pivotally mounted arms carrying a friction roll engaging said cloth as it is wound on said center wound roll;

power operated means exerting a force against said arms positioning said friction roll adjacent with said cloth roll as cloth is being wound thereon;

a motor driving said center wound roll;

a tension control roll engaged by said cloth moving toward said friction roll, moved responsive to variations in tension in said cloth occurring ahead of the friction roll;

control means operable in response to movement of said tension control roll controlling the operation of said motor;

a second motor driving said friction roll for rotation applying tension to said cloth as it is wound on said cloth roll; and a second control means operable in response to pivotal movement of said pivotally mounted arms carrying said friction roll during building of the cloth roll controlling the operation of said second motor varying the tension applied by said friction roll to said cloth during the build.

2. A tension control for a cloth takeup having a center wound core roll receiving cloth from a loom building a cloth roll thereon comprising:

pivotally mounted hold down arms carrying a friction roll engaging said cloth as it is wound on said center wound core roll;

power operated means exerting a force against said hold down arm urging said friction roll into a position adjacent the cloth roll in engagement with said cloth as it is being wound;

a first motor driving said center wound core roll;

a second motor driving said friction roll applying tension to said cloth as it is wound on said cloth roll; and a control means operable in response to pivotal movement of said hold down arms during building of the cloth roll varying the tension applied by said friction roll to said cloth.

3. The structure set forth in claim 2 wherein said second control means includes a control arm raised by a hold down arm during the build, and means disengaging said control arm after said build and during further movement of said hold down arm during doffing of said cloth roll.

4. The structure set forth in claim 3 wherein said control arm is engaged by said hold down arm on one end, pivoted in an intermediate portion, and biased downwardly on the other end.

5. The structure set forth in claim 2 including means varying power supplied to said second motor driven by said hold down arms during the build varying the tension exerted on the cloth by said friction roll during the build.

6. A tension control for a cloth takeup having a center wound roll receiving cloth from a loom comprising:

hold down arms carrying a friction roll engaging said cloth as it is wound on said center wound roll;

power operated means exerting a force against said hold down arms positioning said friction roll for engagement with said cloth;

a first motor driving said center wound roll;

a tension control roll oscillated responsive to variations in tension in said cloth;

first control means controlling operation of said first motor;

a second motor driving said friction roll applying tension to said cloth as it is wound on said cloth roll; and a second control means varying the tension applied by said friction roll to said cloth during the build.

7. The structure set forth in claim 6 wherein said power operated means includes an air cylinder.

8. The method of winding cloth upon a cloth roll utilizing a friction roll applying tension to the cloth as it is received upon said cloth roll comprising the steps of:

utilizing a tension control roll to control the tension in the cloth ahead of said friction roll; and driving said friction roll at a varying speed controlled by said cloth roll during the build of the cloth upon the cloth roll during winding.

9. The method set forth in claim 8 including the step of varying said speed by connecting an arm to move in response to the cloth roll during the build thereof, and disconnecting said arm during doffing of the cloth roll.

10. The method set forth in claim 8 including the step of utilizing an air cylinder to exert a force upon said friction roll positioning same adjacent said cloth roll.

* * * * *